US005682585A

United States Patent [19]

Yamaguchi et al.

[11] Patent Number: 5,682,585

[45] Date of Patent: Oct. 28, 1997

[54] DEVELOPING APPARATUS GENERATING ELECTRIC FIELD BETWEEN DEVELOPER CARRYING MEMBER AND DEVELOPER LAYER REGULATING MEMBER

[75] Inventors: Seiji Yamaguchi, Tokyo; Takahiro Inoue, Yokohama; Kazushige Sakurai, Kawasaki; Junichi Kato, Sagamihara; Kouichi Suwa, Yokohama; Masaki Ojima, Inagi; Hiroshi Sato; Satoru Inami, both of Tokyo; Tetsuya Sano; Atsutoshi Ando, both of Yokohama, all of Japan

[73] Assignee: Canon Kabushiki Kaisha, Tokyo, Japan

[21] Appl. No.: 363,013

[22] Filed: Dec. 23, 1994

[30] Foreign Application Priority Data

Dec. 24, 1993 [JP] Japan ..... 5-347980
Dec. 24, 1993 [JP] Japan ..... 5-347981

[51] Int. Cl.[6] ..... G03G 15/08; G03G 15/09

[52] U.S. Cl. ..... 399/274; 399/284

[58] Field of Search ..... 355/251, 253, 355/259; 399/55, 264, 274, 284

[56] References Cited

U.S. PATENT DOCUMENTS

| | | | |
|---|---|---|---|
| 4,286,543 | 9/1981 | Ohnuma et al. | 118/657 |
| 4,391,512 | 7/1983 | Nakamura et al. | 355/251 X |
| 4,597,661 | 7/1986 | Yamashita | 355/251 X |
| 4,755,847 | 7/1988 | Matsushiro et al. | 355/259 |
| 4,814,818 | 3/1989 | Fuma et al. | 355/251 X |
| 4,967,231 | 10/1990 | Hosoya et al. | 355/259 X |
| 4,989,044 | 1/1991 | Nishimura et al. | 355/251 |
| 5,066,979 | 11/1991 | Goto et al. | 355/208 |
| 5,353,104 | 10/1994 | Kato et al. | 355/259 |

FOREIGN PATENT DOCUMENTS

| | | |
|---|---|---|
| 57-094767 | 6/1982 | Japan . |
| 58-072971 | 5/1983 | Japan . |
| 59-174861 | 10/1984 | Japan . |
| 60-002967 | 9/1985 | Japan . |
| 61-029868 | 2/1986 | Japan . |
| 1-094368 | 4/1989 | Japan . |

OTHER PUBLICATIONS

Patent Abstracts of Japan, vol. 13, No. 329 (P–904), Jul. 25, 1989.

Patent Abstracts of Japan, vol. 10, No. 183 (P–472), Jun. 26, 1986.

Patent Abstracts of Japan, vol. 9, No. 116 (P–357), May 21, 1985.

Patent Abstracts of Japan, vol. 9, No. 30 (P–333), Feb. 8, 1985.

Patent Abstracts of Japan, vol. 7, No. 168 (P–212), [1313] Jul. 23, 1983..

Patent Abstracts of Japan, vol. 6, No. 179 (P–142), Sep. 14, 1982.

"Production of Thin, Uniform Toner Layers Through Use of a Contact Blade with Mono–Component Development Systems"IEEE Transactions on Industry Applications, K. Terao, et al, vol. 27, No. 3, May 1, 1991, pp. 495–500.

*Primary Examiner*—Fred L. Braun

*Attorney, Agent, or Firm*—Fitzpatrick, Cella, Harper & Scinto

[57] ABSTRACT

A developing apparatus includes a developer carrying member for carrying developer, opposed to an image bearing member for bearing an electrostatic image; a regulating member for regulating an amount of the developer to be applied on the developer carrying member; and electric field generator for generating an oscillating electric field between the developer carrying member and the regulating member; wherein the amount of the developer to be applied on the developer carrying member is regulated to no less than 0.6 mg/cm$^2$ and no more than 1.5 mg/cm$^2$ by the regulating member.

18 Claims, 12 Drawing Sheets

DEVELOPING APPARATUS GENERATING ELECTRIC FIELD BETWEEN DEVELOPER CARRYING MEMBER AND DEVELOPER LAYER REGULATING MEMBER

FIELD OF THE INVENTION AND RELATED ART

The present invention relates to a developing apparatus which is used in an image forming apparatus such as copying machine, printer or the like, and develops an electrostatic image on an image bearing member.

In an image forming apparatus employing the electrophotographic system or electrostatic recording system, an electrostatic image formed on an image bearing member such as photosensitive member is developed with a developing apparatus.

Generally speaking, in order to develop the electrostatic image, a toner layer with a predetermined thickness is formed on a developing sleeve of the developing apparatus.

A recent trend is to reduce the toner particle diameter to a range of 6 μm to 9 μm so that the electrostatic image resolution can be improved. The number of particles (count) per unit volume of the toner with the reduced diameter is much larger compared to that of the toner with a larger particle diameter, which makes it difficult to give all the toner particles an equal opportunity to come in contact with the surface of the developing sleeve and/or a developing blade. In other words, it is difficult to charge uniformly all the toner particles. Therefore, in order to improve the toner charging efficiency, a great amount of effort has been exerted to reduce the thickness of the toner layer coated on the developing sleeve, so that the chance for the toner to come in contact with the developing sleeve and/or developing blade is increased.

However, when the toner is excessively charged, a layer of heavily charged toner, that is, so-called overcharged toner layer, is formed on the surface of the developing sleeve or developing blade.

The formation of this overcharged toner layer occurs in the following manner. The overcharged toner is affected by an electrostatic mirror force proportional to the distance from the developing sleeve or developing blade, and the amount of the charge the toner carries. The toner adhering to the surface of the developing sleeve or developing blade is also affected by other physical forces that attract the toner. Therefore, once the overcharged toner adheres to the surface of the developing sleeve or developing blade, it is not easy to remove it from the surface.

Besides, this overcharged toner layer prevents the next supply of toner from coming in contact with the developing sleeve or developing blade. Therefore, the amount of the intra-toner frictional charge inevitably increases. This results in an increase in the relative amount of the toner charged to the opposite polarity, that is, so-called reversal toner, which leads to the image density deterioration and/or increase in the fogginess in the non-image area.

Further, since the overcharged toner layer reduces the toner charging efficiency, the toner is liable to be non-uniformly charged. In particular, in a low humidity environment, the toner within the overcharged toner layer on the developing sleeve is further charged, which is liable to cause irregularity in the toner charge and/or toner layer coat.

When the toner in this overcharged toner layer is sent into The developing station, the amount of toner on the image region, which is developed, becomes different from that on the non-image region, which is not developed. As a result, a phenomenon called "ghost" occurs; in other words, the preceding image affects the following one.

As is evident from the above description, the overcharged toner layer formed on the developing sleeve brings forth a lot of ill effects. In particular, when the toner with a reduced diameter is used, it adheres to the developing sleeve and developing blade more tightly and compactedly, rendering the ill effects more conspicuous.

Thus, the applicant of the present invention has proposed, in a U.S. Pat. No. 5,519,472 which issued on May 21, 1996, to form an electric field between the developing sleeve and developing blade so that the toner is vibrated.

SUMMARY OF THE INVENTION

The primary object of the present invention is to provide a developing apparatus capable of preventing the formation of the overcharged toner layer on the developing sleeve.

Another object of the present invention is to provide a developing apparatus capable of preventing the occurrence of irregular density and reversal fog.

According to an aspect of the present invention, there is provided a developing apparatus comprising: a developer carrying member for carrying developer, opposed to an image bearing member for bearing an electrostatic image; a regulating member for regulating an amount of the developer to be applied on the developer carrying member; and electric field generating means for generating an oscillating electric field between the developer carrying member and the regulating member; wherein the amount of the developer to be applied on the developer carrying member is regulated to no less than 0.6 mg/cm$^2$ and no more than 1.5 mg/cm$^2$ by the regulating member.

According to another aspect of the present invention, there is provided a developing apparatus comprises: developer carrying member for carrying developer, opposed to an image bearing member bearing an electrostatic image; a regulating member for regulating a thickness of the developer layer to be carried on the developer carrying member, the regulating member comprising an electrode, of which width in the moving direction of the developer carrying member is no less than 0.3 mm and no more than 2.0 mm; an electric field generating means which generates an electric field between the developer carrying member and electrode.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Below, the preferred embodiment examples of the present invention will be described with reference to the drawings.

Figure 3:
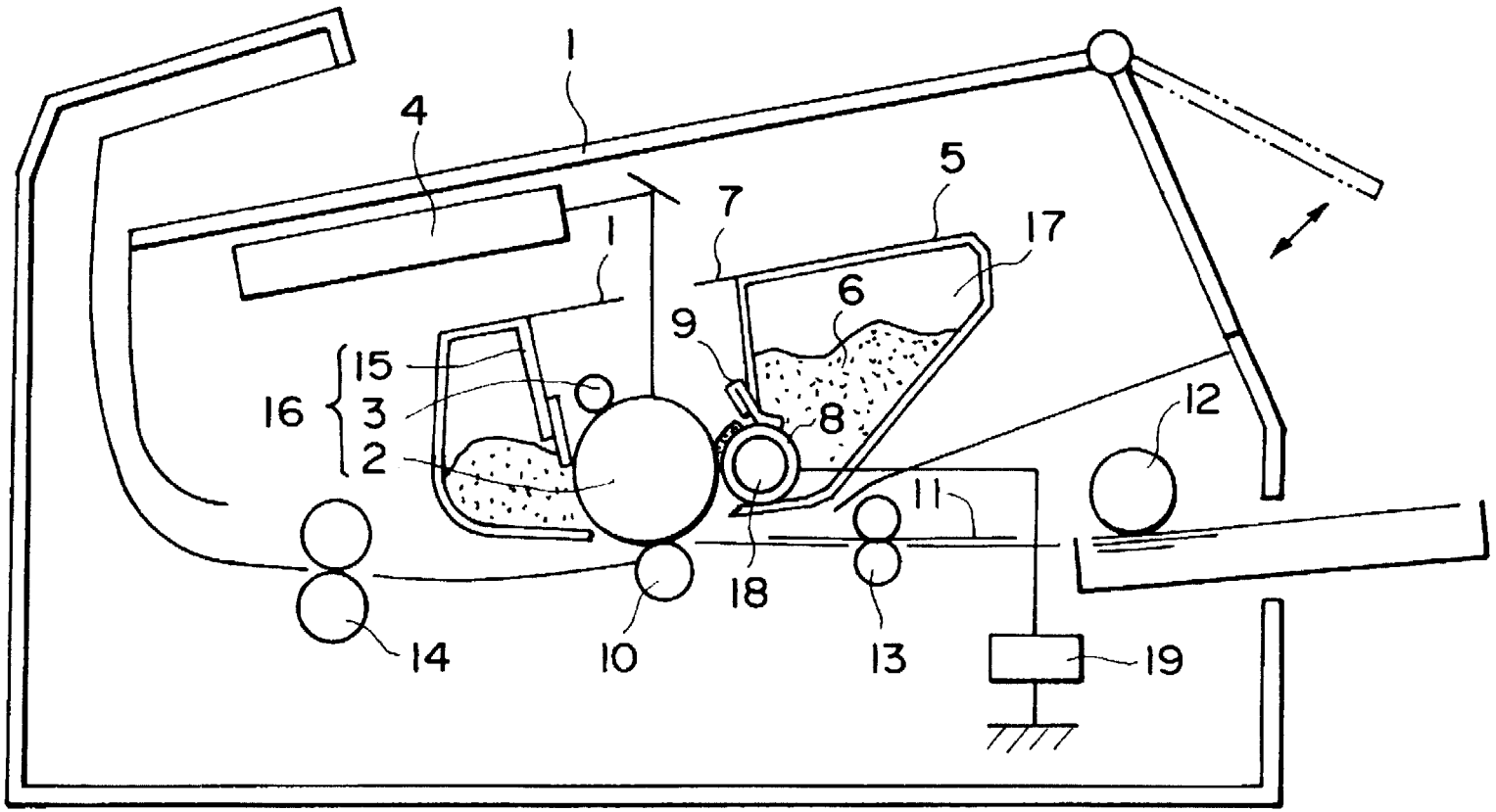
FIG. 3 is a schematic sectional view of an electrophotographic recording apparatus, and depicts its general structure.

FIG. 3 is a sectional view of an electro-photographic image forming apparatus comprising an example of the embodiment of the present invention.

The image forming apparatus comprises a photosensitive drum 2 as a latent image bearing member, which is disposed substantially in the middle of an electro-photographic recording apparatus 1. The photosensitive drum 2 rotates about its axle in a predetermined direction, and after being uniformly charged on the surface by a charging apparatus 3, it is exposed by an exposing apparatus 4, whereby a latent image is formed thereon. A developing apparatus 5 disposed so as to face directly the photosensitive drum 2 comprises a hopper 7 which stores a developer 6, and a developing sleeve 8 as the developer carrying member, and supplies the developer 6 to the latent image formed on the photosensitive drum 2 so that it is visualized. A developing blade 9 is a regulating member which regulates the amount of the developer to be delivered to a developing station, and is disposed close to the developing sleeve 8. A bias power source 19 is connected between the photosensitive drum 2 and developing sleeve 8 so that a proper amount of developing bias is supplied. In this embodiment, the bias voltage comprises a DC component and an AC component superimposed thereon.

The image on the photosensitive drum 2 visualized by the developer 6 is transferred onto a transfer medium 11 by a transfer apparatus 10. The transfer medium 11 is fed in by a sheet feeder roller 12, and then, is delivered to the transfer apparatus 10 by a register roller 13 in synchronism with the image borne on the photosensitive drum 2. The visualized image (developer image) transferred onto the transfer medium 11 by the transfer apparatus 10 is delivered together with the transfer medium 11 to a fixing apparatus 14, in which it is fixed to the transfer medium 11 by heat and pressure, so that it turns into a permanent recorded image. On the other hand, the developer 6 remaining on the photosensitive drum 2 after the image transfer, that is, the developer 6 which is not transferred during the image transfer, is removed by a cleaning apparatus 15. The surface of the photosensitive drum 2 cleared of the developer 6 is again charged by the charging apparatus 3 to be used for the next image forming process which is the same as the one described above.

In the above electro-photographic recording apparatus, the developing apparatus 5 is in the form of a process unit, so that maintenance can be simplified, and also, the photosensitive drum 2, cleaning apparatus 15, and charging apparatus 3 are integrated into a cleaning unit 16. These units are in the form of an exchangeable cassette. The above two units may be further integrated into a process cartridge 17, so that the maintenance can be further simplified, and in these days, such a process cartridge 17 is very popular. The developer used for this type of process unit or process cartridge is single component magnetic developer which does not require a carrier, and therefore, a magnet 18 is disposed within the developing sleeve 8 to retain the developer on the developing sleeve 8. The diameter of the developer particle is in a range of 6 μm to 9 μm.

Figure 1:
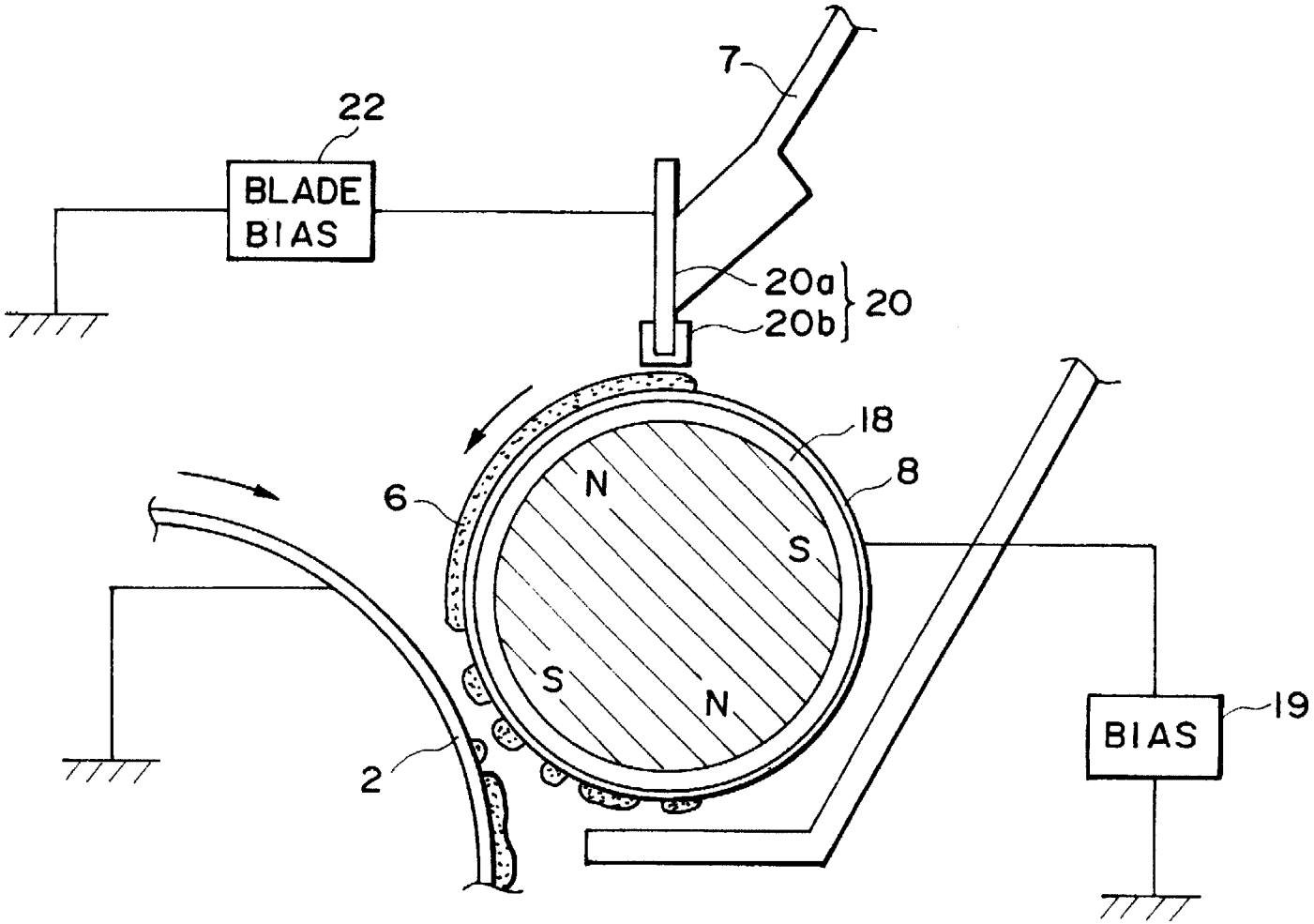
FIG. 1 is a schematic sectional view of an essential portion of a first example of the embodiment of developing apparatus according to the present invention.

Referring to FIG. 1, the first example of the embodiment of the developing apparatus according to the present invention will be described. A developing blade 20 comprises a supporting metallic plate 20*a* fixed to the hopper 7, and a piece of 1 mm thick urethane rubber 20*b*. This urethane rubber 20*b* covers the developing sleeve side surface of the supporting metallic plate 20*a*, so as to prevent a leak between the developing blade 20 and developing sleeve 8. The tip of the urethane rubber 20*b* is disposed 150 μm away from the developing sleeve 8. The supporting metallic plate 20*a* is connected to a blade bias power source 22 as voltage applying means, so that a predetermined bias voltage can be applied to the developing blade 20.

The developing sleeve 8 is formed of a drawn aluminum tube, and its surface has been sandblasted with alundum abrasive. In the developing sleeve 8, a magnet 18 is disposed to retain the magnetic developer 6, on the sleeve surface. The developing sleeve 8 is connected to a development bias power source 19, so that a development bias is applied between the developing sleeve 8 and photosensitive drum 2. Further, the developing sleeve 8 and photosensitive drum 2 are disposed so as to maintain a gap of 300 μm therebetween. The specifications of the developing apparatus is as follows.

| | |
|---|---|
| Developing sleeve | |
| surface treatment | sandblasting |
| external diameter | 15 mm |
| peripheral velocity | 50 mm/sec |
| Developing blade | |
| positioning | close to sleeve |

The magnetic toner 6 used in this embodiment is a dielectric, single component magnetic developer, and its volumetric average particle diameter is approximately 6 μm. According to the results of an experiment, the value of the toner charge q of this magnetic toner 6 seldom exceeded the $10^{-13}$ C, and also, the value of the electrostatic mirror force F of individual toner seldom went over $10^{-7}$. Therefore an intensity E of the electric field necessary for peeling the toner off the developing sleeve 8 could be obtained from the following equation:

$$F=q\cdot E$$

(F: electrostatic mirror force, q: level of toner charge, E: electric field intensity)

Therefore, $E=10^6$ V/M, with the result that when the intensity of an oscillating electric field exceeded approximately $10^6$ V/M, the overcharged toner layer could be peeled away from the developing sleeve 8 by the force of the electric field alone. When the electric field was further intensified, the leak began to occur frequently approximate beyond $10^8$ V/M.

Taking into consideration the matter described in the foregoing, a development bias with the following specifications was applied.

| | |
|---|---|
| DC voltage | −400 V |
| AC voltage | 2 kVpp |
| Frequency | 2 kHz |
| Waveform | Rectangular |

The blade bias was a DC voltage of 0 V, with no AC component. In other words, the developing blade was grounded.

In this embodiment, the development bias was applied between the developing sleeve and developing blade, whereby a force attracting the developing blade was generated due to the electric potential difference between the developing sleeve and developing blade. As a result, the developing blade vibrated. Therefore, the developer was subjected to both the electric field force end the blade vibration. The wave-form of the electric field may any form as long as it can generate vibration and an electric field which can remove the overcharged toner layer in the manner described above. For example, the blade bias may have a triangular or saw-tooth waveform.

Image quality was evaluated Under the above conditions, while varying the center line average height Ra (JIS.B-0601) between 0.2 μm and 2.5 μm.

The results are given in the following table (Table 1).

TABLE 1

| Ra (μm) | 0.2 | 0.5 | 0.8 | 1.2 | 1.5 | 2.0 | 2.5 |
|---|---|---|---|---|---|---|---|
| M/S (mg/cm²) | 0.3 | 0.6 | 0.8 | 1.2 | 1.5 | 1.6 | 1.7 |
| DENSITY NON-UNIFORMITY | N | F | G | G | G | G | G |
| REVERSE FOG | G | G | G | G | F | N | N |
| GHOST | N | F | F | G | G | G | G |

M/S: amount of developer on sleeve
G: Good
F: Practically no-problem
N: No good

As is evident from Table 1, when the M/S (amount of the developer coated on the developing sleeve as the developer carrying member per unit area) was no more than 0.6 mg/cm², the developer layer became thin, that is, the absolute quantity of the developer was reduced. As a result, the density irregularity caused by the insufficient developer coating became conspicuous. In addition, since the developer supplying capacity of the developing sleeve declined as the M/S declined, the portion of the developer on the developing sleeve, which had been consumed in the preceding image forming process, could not be smoothly replenished, which was liable to create a sleeve ghost of a negative image.

Further, when the M/S exceeds 1.5 mg/cm², a reversal fog was created. This was because the developer layer thickened; the thickened layer prevented the developer particles from coming uniformly in contact with the developing blade and/or developing sleeve, and as a result, they could not be uniformly charged.

The above results confirm that a preferable image can be obtained when the M/S falls within a range of 0.6 mg/cm² to 1.5 mg/cm².

Generally, the M/S is regulated by the state of developing blade contact (in this case, the gap between the developing sleeve and developing blade) and the coarseness of the developing sleeve surface. In this embodiment, the distance between the developing blade and developing sleeve surface was reduced to the mechanical limit in order to reduce the thickness of the developer layer. This method alone was not sufficient to control precisely the M/S. Therefore, a method of adjusting the Ra of the developing sleeve was employed as an effective method to control more precisely the M/S. In other words, the Ra was adjusted to fall within a range of 0.5 μm to 1.5 μm, so that the M/S fell within the above preferable M/S range.

EMBODIMENT 2

Figure 2:
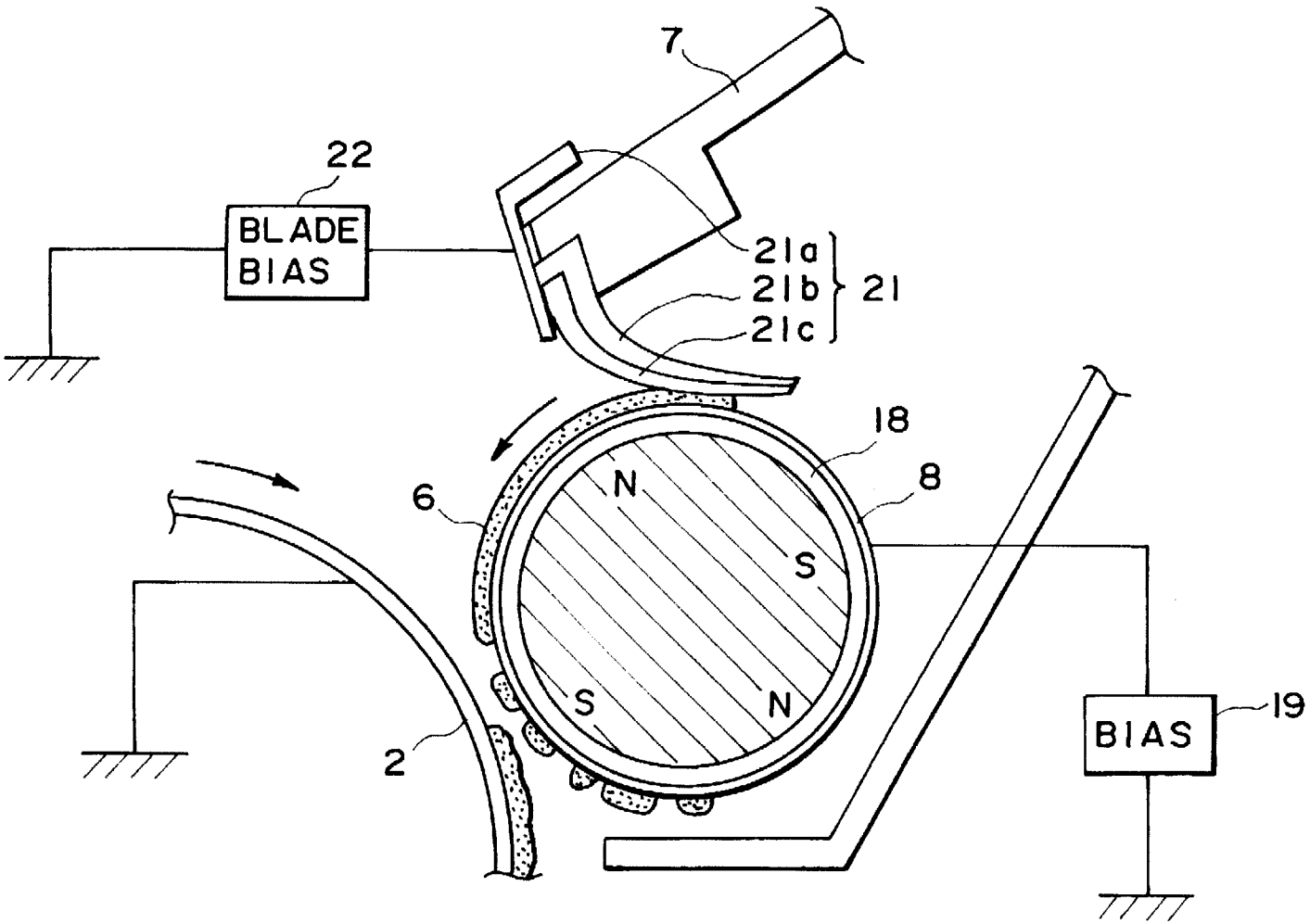
FIG. 2 is a schematic sectional view of an essential portion of a second example of the embodiment of developing apparatus according to the present invention.

Next, referring to FIG. 2, the second example of the embodiment of the developing apparatus according to the present invention will be described. A developing blade 21 comprises: a supporting metallic plate 21*a* fixed to a hopper 7; an electrically conductive rubber layer (EPDM in which carbon is dispersed) 21*b*, which is adhered to the supporting metallic plate 21*a* and constitutes an electrode; and an approximately 50 μm thick, highly resistant urethane resin layer 21*c*, which covers the developing sleeve side surface of the conductive rubber layer 21*b*. The high resistance urethane rubber layer 21*c* is provided for preventing a leak between the developing blade 21 and developing sleeve 8. The tip of the high resistance urethane resin layer 21*c* is extended in the direction opposite to the rotational direction of the developing sleeve 8 and is placed in contact with the developing sleeve 8. The supporting metallic plate 21*a* is connected to a blade bias power source 22, so that a predetermined bias voltage can be applied to the developing blade 21.

The developing sleeve 8 is formed of a drawn aluminum tube, and its surface has been sandblasted with the ALUNDUM abrasive. In the developing sleeve 8, a magnet 18 is disposed to retain the magnetic developer 6, on the sleeve surface. The developing sleeve 8 is connected to a development bias power source 19, so that a predetermined development bias is applied between the developing sleeve 8 and photosensitive drum 2.

The magnetic toner 6 is a dielectric, single component, magnetic developer, which is negatively chargeable and has a volumetric average particle diameter of approximately 6 μm. The width the contact surface between the developing sleeve and developing blade in the rotational direction is approximately 2 mm, and the contact pressure in the longitudinal direction is set at approximately 20 g/cm. The other conditions are as follows:

| | |
|---|---|
| Developing sleeve | |
| surface treatment | sandblasting |
| external diameter | 15 mm |
| peripheral velocity | 50 mm/sec |
| Developing blade | |
| positioning | pressed on sleeve |
| Development bias | |
| DC voltage | −400 V |
| AC voltage | 2 kVpp |
| Frequency | 2 kHz |
| Waveform | Rectangular |

The blade bias is a DC voltage of 0 V, and no AC voltage is applied. In other words, the developing blade is grounded.

The image quality was evaluated under the above conditions while varying the Ra of the developing sleeve between 0.2 μm and 2.5 μm.

The results are given in the following table (Table 2).

TABLE 2

| Ra (μm) | 0.2 | 0.5 | 0.8 | 1.2 | 1.5 | 2.0 | 2.5 |
|---|---|---|---|---|---|---|---|
| M/S (mg/cm$^2$) | 0.3 | 0.6 | 0.8 | 1.2 | 1.5 | 1.6 | 1.7 |
| DENSITY NON-UNIFORMITY | N | F | G | G | G | G | G |
| REVERSE FOG | G | G | G | G | G | N | N |
| GHOST | N | F | F | G | G | G | G |

M/S: amount of developer on sleeve
G: Good
F: Practically no-problem
N: No good

As shown in Table 2, it was confirmed that when the M/S was 1.5 mg/cm$^2$ the amount of the reversal fog was less than it was in the first embodiment example. As for the cause of this result, are conceivable. Firstly, the developer could be efficiently charged through the friction, since the developing blade was placed in contact with the developing sleeve. Secondly, the mechanical vibration could be applied, in addition to the oscillating electric field, since the developing blade was placed in contact with the developing sleeve.

When the M/S is no more than 0.6 mg/cm$^2$, the absolute quantity of the developer borne on the developing sleeve surface was reduced. As a result, the density irregularity caused by an insufficient developer coating became conspicuous. Therefore, a second test was conducted in which the peripheral velocity of the developing sleeve was increased to increase the amount of the developer delivered per unit time, so that the density irregularity was reduced. In this test, the structure of the apparatus was the same as the one in the first test, except that the peripheral speed of the developing sleeve was increased 1.5 times that of the photosensitive drum. The results are given in the following table (Table 3).

TABLE 3

| Ra (μm) | 0.2 | 0.5 | 0.8 | 1.2 | 1.5 | 2.0 | 2.5 |
|---|---|---|---|---|---|---|---|
| M/S (mg/cm$^2$) | 0.3 | 0.6 | 0.8 | 1.2 | 1.5 | 1.6 | 1.7 |
| DENSITY NON-UNIFORMITY | N | G | G | G | G | G | G |
| REVERSE FOG | G | G | G | G | G | N | N |
| GHOST | N | F | F | G | G | G | G |

M/S: amount of developer on sleeve
G: Good
F: Practically no-problem
N: No good

As is evident from Table 3, when the M/S was 0.3 mg/cm$^2$ and the Ra was 0.2 μm, the same density irregularity as those in the preceding embodiments was observed, but when the M/S was 0.6 mg/cm$^2$ and the Ra was 0.5 μm, the density irregularity was improved in comparison with when the peripheral velocity of the developing apparatus was 50 mm/sec. This was because of the following reason. Since the peripheral velocity of the developing sleeve was faster than that of the photosensitive drum, the amount of the developer delivered to the photosensitive drum increased, compensating for the slight developer coating irregularity. As a result, the effect of the developer coating irregularity was less conspicuous.

Further, it was confirmed that even when the peripheral velocity of the developing sleeve was set at 1.5 times, the results were consistent with all of the results of the first and second embodiment examples, and also, the employment of a developing sleeve with a low Ra was effective to reduce the density irregularity. However, when the peripheral velocity of the developing sleeve was excessively increased, the developing sleeve and toner deteriorated faster, and also, a heavy load was exerted on the driving means. In other words, there was a limit to the peripheral velocity ratio of the developing sleeve relative to that of the photosensitive drum. In this embodiment, a ratio of 1.5 time was set as the limit.

EMBODIMENT 3

Next, a third embodiment example will be described. This embodiment example was characterized in that the developing sleeve surface was coated with phenol resin in which carbon (graphite) was dispersed using dispersant. The other structures were the same as those in the second example. The ratio among the phenol resin, carbon (graphite), and dispersant was 20:9:1. The other conditions were as follows:

| | |
|---|---|
| Developing sleeve | |
| surface treatment | phenol resin coat |
| external diameter | 15 mm |
| peripheral velocity | 1.5 time drum velocity |
| Developing blade | |
| positioning | pressed on sleeve |
| Development bias | |
| DC voltage | −400 V |
| AC voltage | 2 kVpp |
| Frequency | 2 kHz |
| Waveform | Rectangular |

The blade bias was a. DC voltage of 0 V, and no AC voltage was applied. In other words, the developing blade was grounded.

The image quality was evaluated under the above conditions while varying the Ra of the developing sleeve between 0.2 μm and 2.5 μm. The results are given in the following table (Table 4).

TABLE 4

| | | | | | | | |
|---|---|---|---|---|---|---|---|
| Ra (μm) | 0.2 | 0.5 | 0.8 | 1.2 | 1.5 | 2.0 | 2.5 |
| M/S (mg/cm$^2$) | 0.3 | 0.6 | 0.8 | 1.2 | 1.5 | 1.6 | 1.7 |
| DENSITY NON-UNIFORMITY | N | G | G | G | G | G | G |
| REVERSE FOG | G | G | G | G | G | F | N |
| GHOST | N | G | G | G | G | G | G |

M/S: amount of developer on sleeve
G: Good
F: Practically no-problem
N: No good

As shown in Table 4, it was confirmed that when the M/S was 0.6 mg/cm$^2$ and the RA was 0.5 μm, and when the M/S was 0.8 mg/cm$^2$ and the Ra was 0.8 μm, the ghost was effectively reduced.

This was because of the following reasons. Since the graphite particles were dispersed across the developing sleeve surface, the electrostatic mirror force of the developing sleeve was dispersed, being thereby weakened. As a result, the developer adhered less to the developing sleeve surface of this embodiment than to the aluminum developing sleeve surface.

Thus, it can be concluded that the developing sleeve coated with the phenol resin, in which carbon (graphite) is dispersed using the dispersant, is more resistive against the surface contamination than the plain aluminum developing sleeve.

It was confirmed from the above results that the preferable image was obtained when the M/S was in a range of no less than 0.6 mg/cm$^2$ and no more than 1.5 mg/cm$^2$.

EMBODIMENT 4

Next, the toner movement will be described in detail with respect to a fourth embodiment example.

Figure 4:
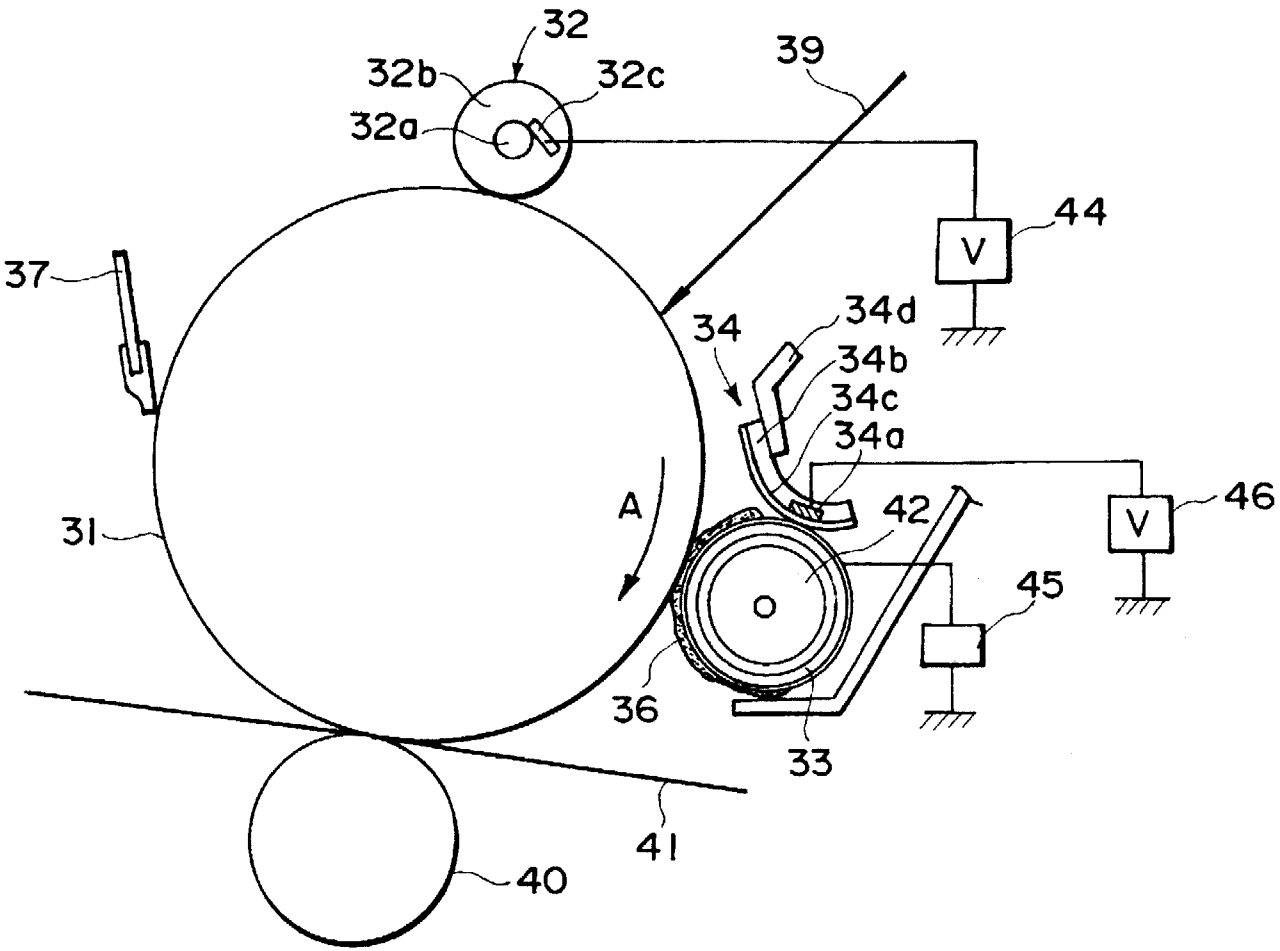
FIG. 4 is a schematic sectional view of an image forming apparatus comprising the developing apparatus in another example of the embodiment of the present invention.

An elastic blade 34 of the developing apparatus illustrated in FIG. 4 comprises an elastic blade base **34*b* of dielectric material such as urethane, an electrode 34*a* of electrically conductive material such as nylon in which carbon is dispersed, and a high resistance layer 34*c* of urethane resin or the like. The electrode 34*a* is disposed on the elastic blade base 34*b*. The elastic blade base 34*b* is covered with the high resistance layer 34*c*, entirely or at least on the developing sleeve 33 side surface. The elastic blade 34 is placed in contact with the developing sleeve 33, being extended in the direction opposite to the rotational direction of the developing sleeve 33**.

Further, the electrode **34*a* is connected to a bias power source 46, so that a predetermined blade bias can be applied. The high resistance layer 34*c* of the elastic blade 34 is provided to prevent a leak between the electrode 4*a* and developing sleeve 33**.

Figure 5:
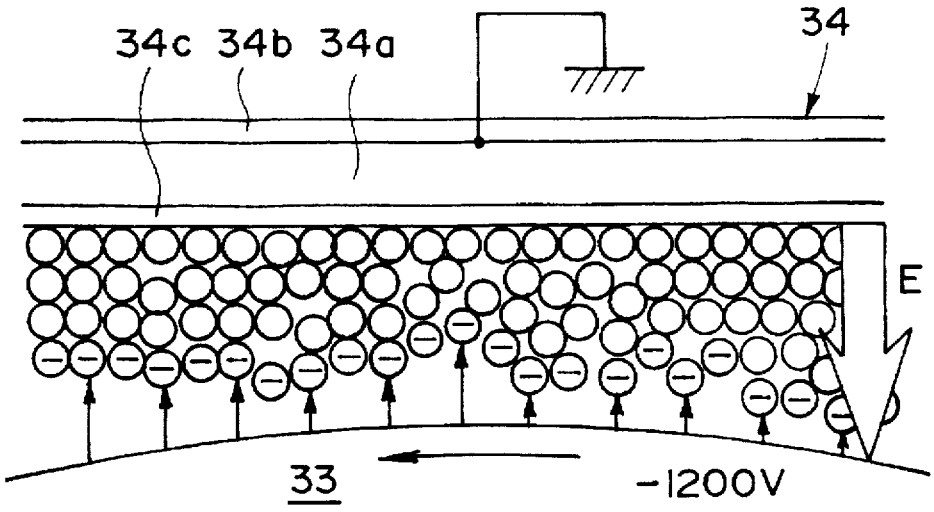
FIG. 5 is an explanatory drawing to describe a force exerted on the toner when the force of the electric field generated by the blade bias is exerted from the direction of the elastic blade toward the developing sleeve, in a frictional area between the elastic blade and developing sleeve of the developing apparatus.

With the above structure in place, an alternating electric field is generated between the electrode **34*a* and developing sleeve 33 by the blade bias from a power source 46, whereby the charged toner within this region is affected by a force proportional to the intensity of this alternating electric field. When this force of the alternating electric field exceeds the electrostatic mirror force working between the overcharged toner and elastic blade 34, and between the overcharged toner and developing sleeve 33, the toner layer covering the elastic blade 34 is peeled off when the direction of the alternating electric field E is reversed from the direction illustrated in FIG. 5 to the direction illustrated in FIG. 6, that is, when it is directed from the developing sleeve 33 toward elastic blade 34. The peeled toner layer is carried away as the developing sleeve 33 rotates. As a result, the contact failure between the new supply of toner and the developing sleeve 33, and/or between the new supply of toner and elastic blade 34**, caused by this layer of overcharged toner is eliminated along with the ill effects of the intra-toner friction charge. Therefore, the reversal toner is also reduced while improving the toner charging efficiency.

Figure 7:
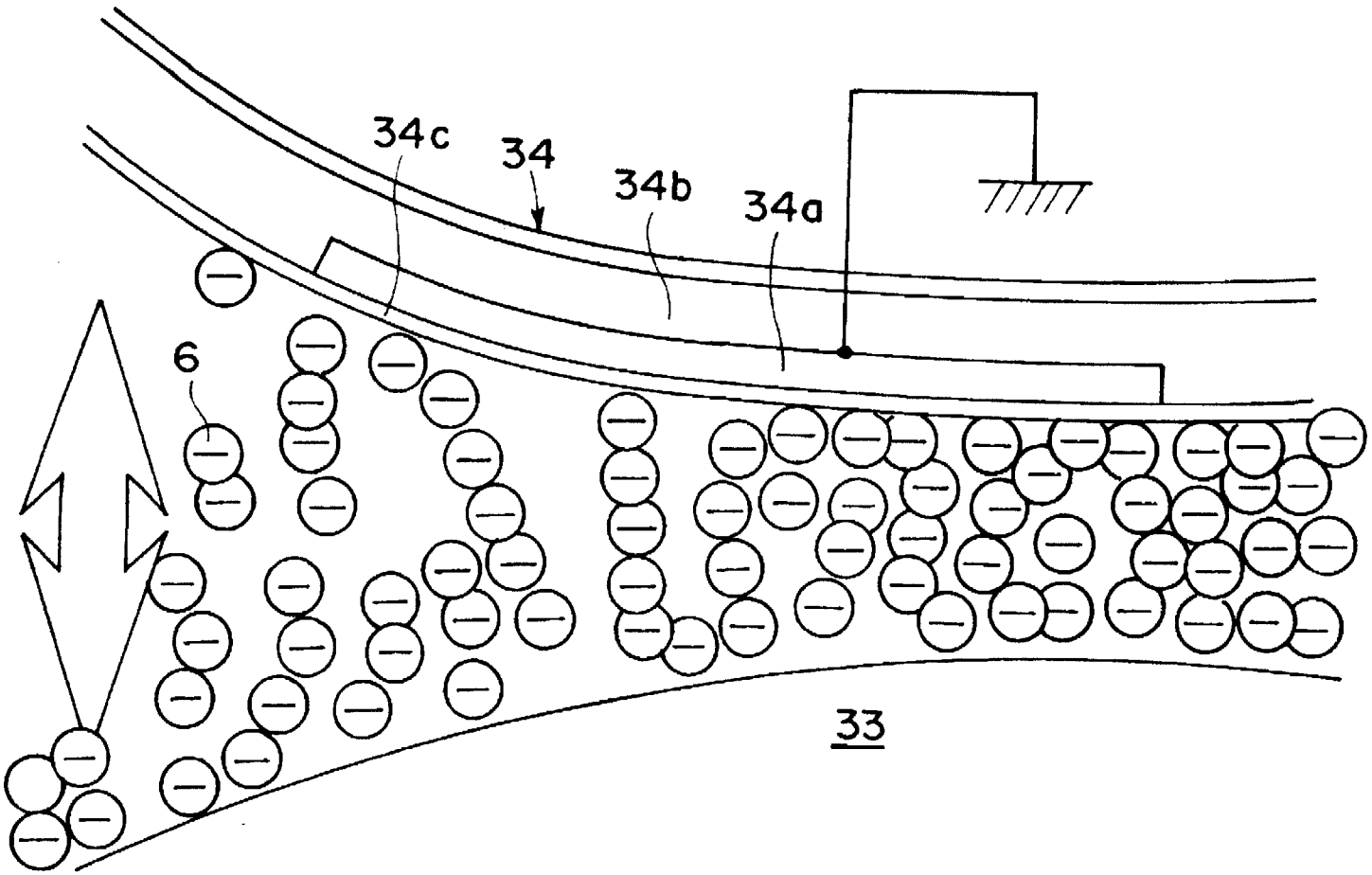
FIG. 7 is an explanatory drawing to describe how the toner moves back and forth on the downstream side of the same frictional area as the one illustrated in FIG. 5.

In particular, on the downstream side of the region in which the elastic blade 34 and developing sleeve 33 rub each other, the toner 36 moves back and forth in response to the alternating electric field as shown in FIG. 7. On the downstream of this region, not only the toner layer covering the elastic blade 34 and/or developing sleeve 33 is peeled off, but also, the toner particles from the peeled off toner layer fly back and forth. As a result, the layer of overcharged toner and the toner chain formed by the magnetic force are loosened and sufficiently stirred. This stirring is effective to eliminate substantially the nonuniform charge, and also, to ease the coating nonuniformity cause by the foreign matter stuck between the elastic blade 34 and developing sleeve 33.

Needless to say, when a control is executed so that the above alternating electric field is constantly applied during the rotation of the developing sleeve 33, the toner layer, which otherwise might cover the elastic blade 34 and/or developing sleeve 33, is not formed, and therefore, the problem such as described above does not occur. Further, when a superimposed voltage composed of a DC voltage and an AC voltage is applied to the electrode **34*a*, not only the toner moves back end forth, but also, the charge correspondent to the DC component of the bias applied to the electrode 34*a*** is injected into the toner borne on the developing sleeve, charging thereby the toner. As a result, the toner can be charged to a predetermined level to obtain the high quality image suffering from no ghost, no fog, and no density irregularity.

Next, another example of the embodiment of the present invention will be described. This embodiment example is more preferable than the others.

EMBODIMENT 5

Figure 8:
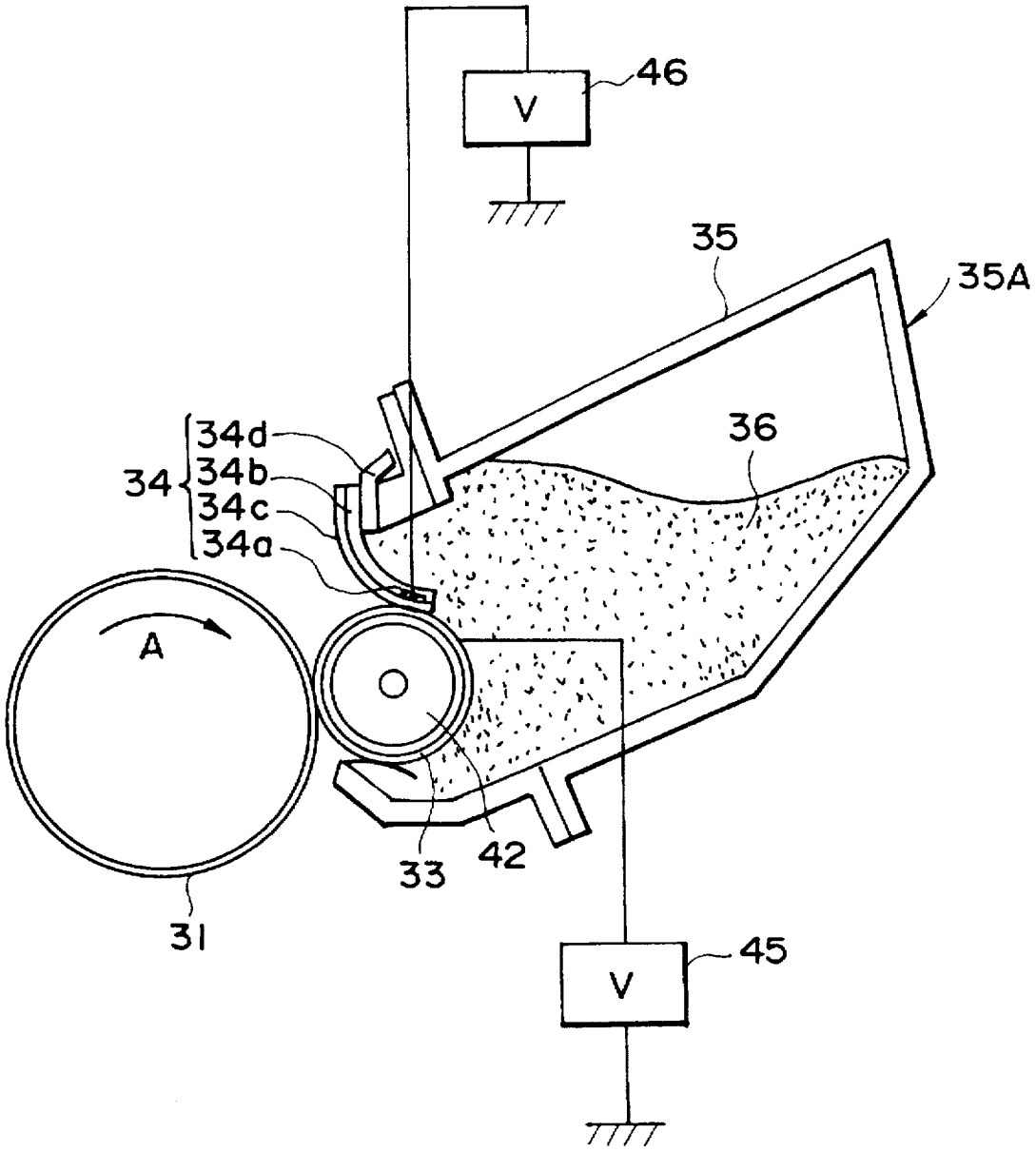
FIG. 8 is a schematic sectional view of an example of the embodiment of image forming apparatus according to the present invention.
Figure 9:
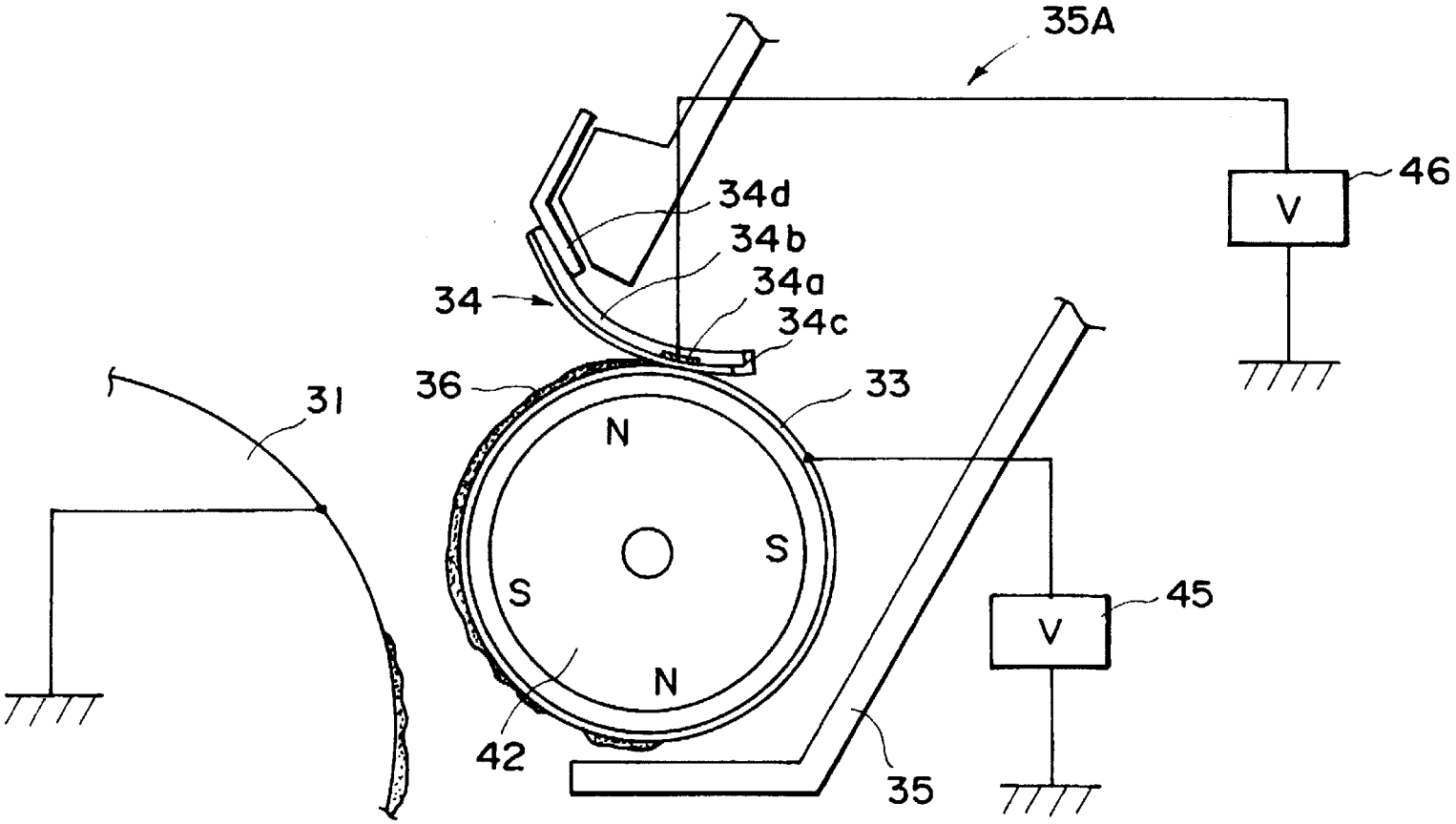
FIG. 9 is an enlarged view of the essential portion of the developing apparatus provided in the image forming apparatus illustrated in FIG. 8.

FIG. 8 is a schematic sectional view of an example of the embodiment of an image forming apparatus according to the present invention, and FIG. 9 is an enlarged view of the essential portion of the developing apparatus within the image forming apparatus illustrated in FIG. 8.

In the developing apparatus **35*a* of this embodiment illustrated in FIGS. 3 and 9, an elastic blade 34 comprises an elastic blade base 34*b* of dielectric material such as urethane, an electrode 34*a* of electrically conductive material such as nylon, in which carbon is dispersed, and a high resistance layer 34*c* of urethane resin or the like. The electrode 34*a* is disposed on the elastic blade base 34*b*. The elastic blade base 34*b* is covered with the high resistance layer 34*c*, entirely or at least on the developing sleeve 33 side surface. The elastic blade 34 is fixed to the developer container, with the use of a supporting member 34*d*, and is placed in contact With the developing sleeve 33, being extended in the direction opposite to the rotational direction of the developing sleeve 33. It may be placed in contact with the developing sleeve 33 so as to extend in the same direction as the rotational direction of the developing sleeve 33**.

Figure 10:
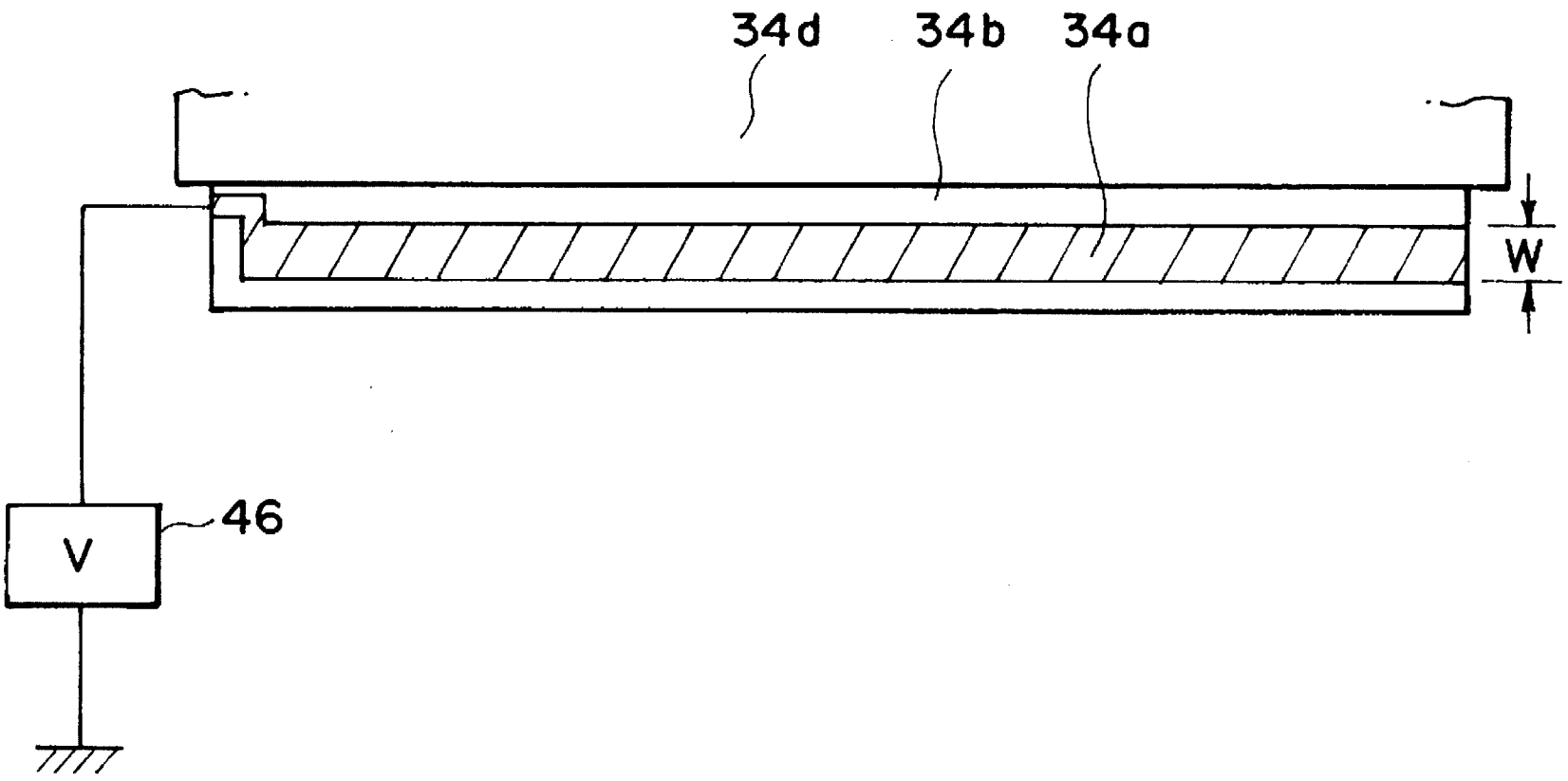
FIG. 10 is a plan view of an elastic blade provided within the developing apparatus illustrated in FIG. 9.

Further, a blade bias power source 46 is connected to the electrode **34*a* provided on the elastic blade 34, and the electrode 4*a* is given a width of w, with respect to the direction perpendicular To the longitudinal direction of the elastic blade 34, being extended in the longitudinal direction of the elastic blade 34 as illustrated by the plan view in FIG. 10, so that the oscillating voltage from the power source 46 can be uniformly applied across the longitudinal direction (the direction parallel with the axial direction of the developing sleeve 33) of the elastic blade 34. According to the present invention, the width w of this electrode 4a** is in a range of no less than 0.3 mm and no more than 2.0 mm.

The magnetic toner 6 of this embodiment example was a negatively chargeable, single component magnetic developer, and its particle diameter was approximately 6 μm. The specifications of the development bias applied to the developing sleeve 33 was as follows:

DC voltage: Vdc=−400 V

AC voltage: rectangular wave amplitude Vac=1.6 kVpp frequency=1,800 Hz

Also, a blade bias having the following specifications was applied to the electrode 4a, under the constant-voltage control, so that its phase became reverse to that of the developing sleeve:

DC voltage: Vdc=−600 V

AC voltage: sine wave amplitude Vac=800 Vpp frequency=1,800 Hz

With the above setup in place, the toner particles 36 in the toner layer on the developing sleeve 33 moves back and force between the elastic blade 34 and developing sleeve 33, being thereby stirred. Therefore, the toner is prevented from being nonuniformly charged, being unevenly coated, and/or being charged to the reverse polarity.

In this embodiment, when the width of the electrode 34a is 1 mm, a current I which flows between the electrode 34a and developing sleeve 33 is:

$$I=(Vpp\times\pi fC)/2^{1/2}$$

C being the electrostatic capacity between the electrode 34a and developing sleeve 33, $$C=\epsilon\times(L\times w/r)$$

(ε: dielectric coefficient, L: electrode 4a length, w: electrode 4a width; r: toner layer thickness)

In this embodiment, $\epsilon=8.85\times10^{-12}$F.m$^{-1}$

L=216 mm w=1 mm r=100 μm

Therefore, the current I which flows between the electrode 4a and developing sleeve 33 is:

$$I\approx180\ \mu A$$

On the contrary, when the electrodes 4a width is 10 mm, the current I which flows between the electrode 4a and developing sleeve 33 is:

$$I\approx1.8\ mA$$

In other words, a larger current flows in comparison with when the electrode 4a width is 1 mm.

Since the width of the electrode 4a provided on the elastic blade 34 of this embodiment is set to be no more than 2 mm, the electrostatic capacity between the electrode 4a and developing sleeve 33 is rather small compared to when the width of the electrode 34a is wider. Therefore, the current which flows between the electrode 34a and developing sleeve 33 can be kept small, which affords a power source 46 of a smaller size, thereby the cost.

With respect to the above described situation, making the electrode 4a width w larger than 2 mm increases the power consumption, but does not enhance the stirring effect as much, since the frictional area width between the developing sleeve 33 and elastic blade 34 is still approximately 2 mm. Further, when the electrode 4a width w is made to be less than 0.3 mm, it is difficult to position properly the electrode 4a on the elastic blade 34. Therefore, the manufacturing efficiency for the developing apparatus decreases, which leads to increases in the production cost.

Thus, in this embodiment example, the width of the electrode 34a provided on the elastic blade 34 was set in a range of no less than 0.3 mm and no more than 2 mm. Such an arrangement makes it possible to reduce the manufacturing cost while reducing the power consumption which occurs as the blade bias is applied to the electrode 4a.

EMBODIMENT 6

Figure 11:
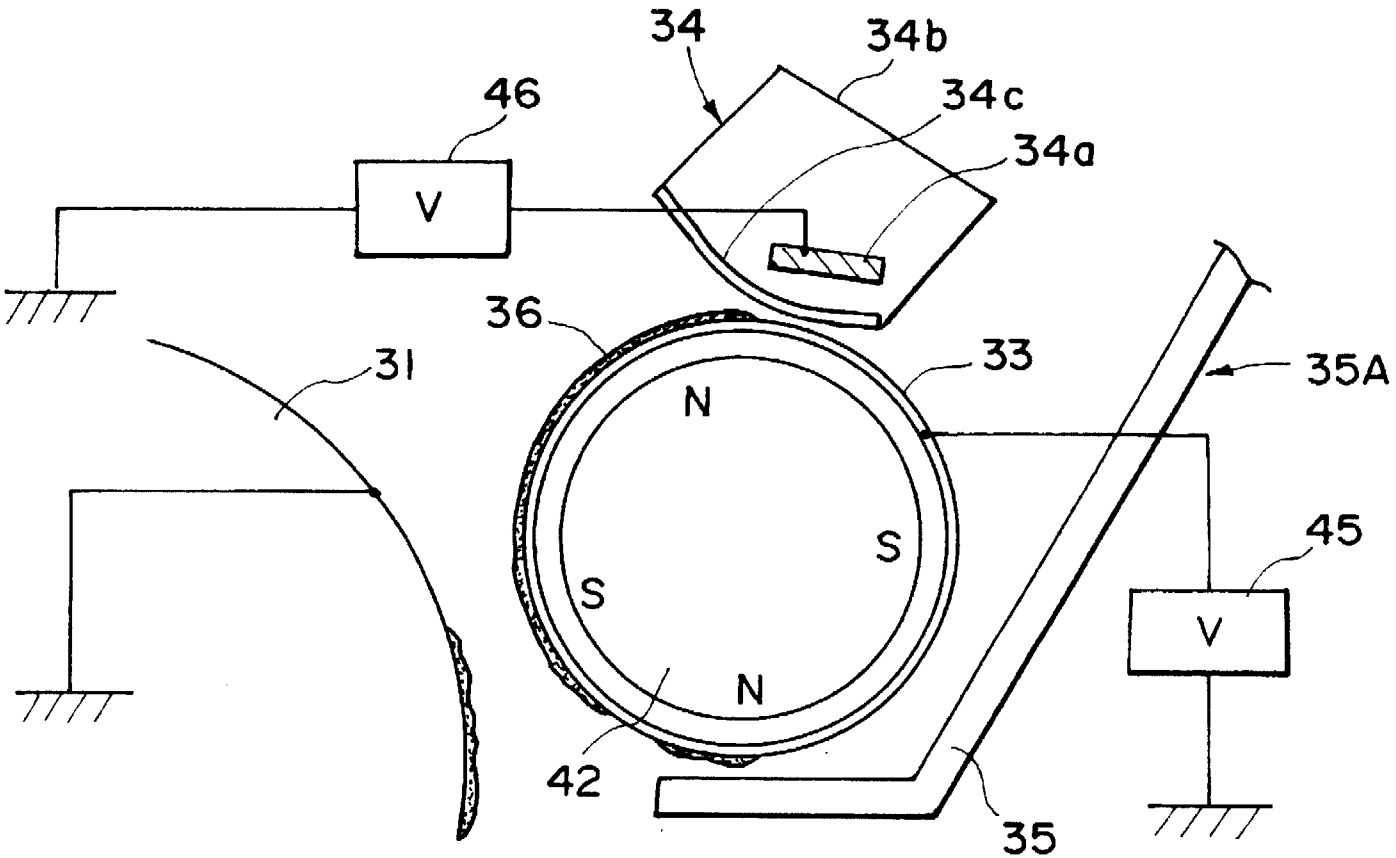
FIG. 11 is a schematic sectional view of another example of the embodiment of developing apparatus according to the present invention.

FIG. 11 is a schematic sectional view of another example of the embodiment of developing apparatus according to the present invention. In this embodiment example, an elastic blade 34 comprises a blade base 34b, an electrode 34a, and a high resistance layer 4c. The electrode 34a is buried in the blade base 34b, and the blade base 34b is covered by the high resistance layer 4c, at least on the developing sleeve 33 side surface. The blade base 34b of this embodiment example is made of hydrin rubber. The other structures are basically the same as those of the fifth embodiment example. When the alphanumeric references given in FIG. 11 are the same as those given in FIGS. 8 and 9, they refer to the same components.

Figure 12:
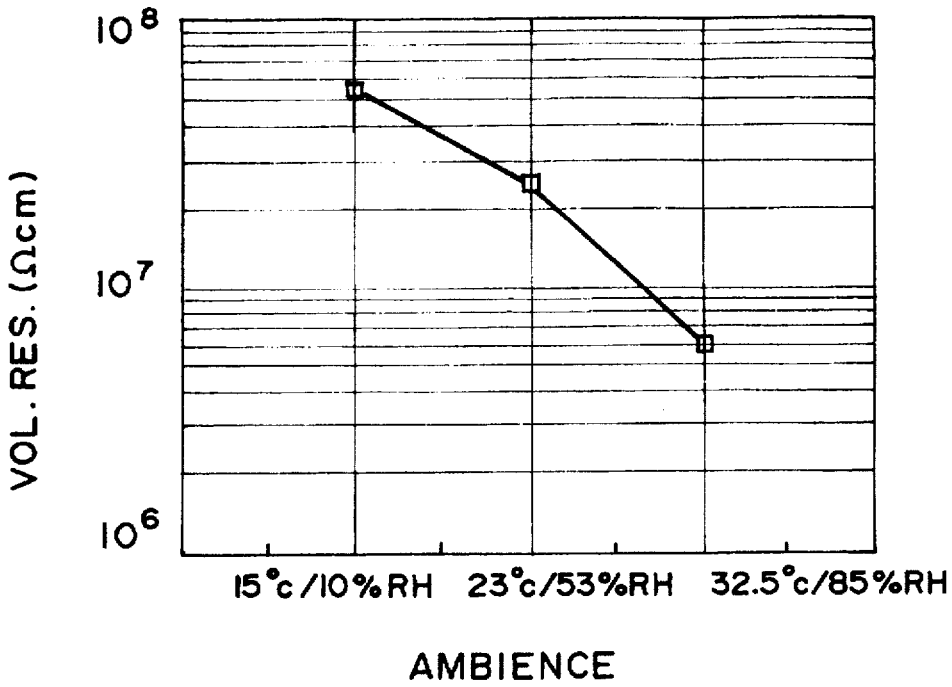
FIG. 12 is a graph showing the changes in the resistance value of the hydrin rubber used as the material for the elastic blade of the developing apparatus illustrated in FIG. 11, which is caused by the environment in which the hydrin rubber is used.
Figure 13:
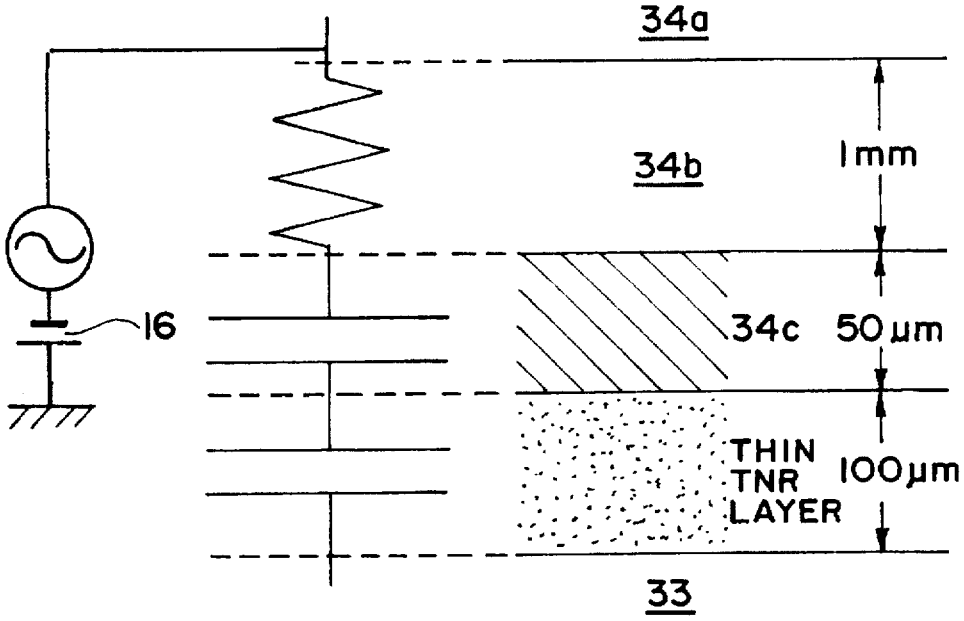
FIG. 13 is an explanatory drawing of an electric circuit equivalent to the circuit formed at the interface between the elastic blade and developing sleeve in the developing apparatus illustrated in FIG. 4.

The hydrin rubber used for the above elastic blade base 34b is characterized in that its resistance value (volumetric resistivity) changes, as shown in FIG. 12, in response to the environment in which it is used (external environment). That is, the hydrin rubber increases its resistance value under a low humidity environment, and decreases it under a high humidity environment.

Figure 6:
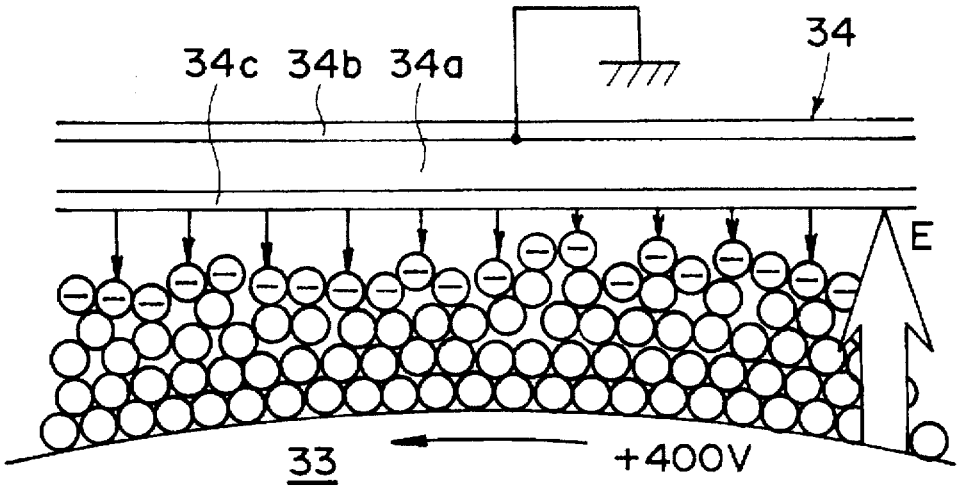
FIG. 6 is also an explanatory drawing to describe a force exerted on the toner when the electric field generated by the blade bias is exerted from the direction of the developing sleeve toward the elastic blade in the same friction area as the one illustrated in FIG. 5.

A circuit, which is formed at the interface between the elastic blade 34 and developing sleeve 33 in this embodiment when the same development bias and blade bias as those in the fifth embodiment example are applied is considered to be electrically equivalent to the circuit illustrated in FIG. 6.

Assuming that the distance between the electrode 34a of the elastic blade 34 and the resistance layer 34c is 1 mm; resistance layer 34c thickness, 50 μm; thickness of the thin layer of toner, 100 μm: and the rest of the conditions are equal to those of the fifth embodiment example, a maximum voltage Vmax exerted between the electrode 34a and developing sleeve 33 under a low temperature-low humidity environment (L/L) of 15° C./10% RH is:

$$Vmax\ (L/L)\approx2.1\times10^{6}V/cm$$

and, under a high temperature-high humidity environment (H/H) of 32.5° C./85% RH $$Vmax(H/H)\approx1.97\times10^{7}V/cm$$

The appropriate range for the value Emax of the maximum voltage which can provides sufficient stirring effects without causing a leak from the elastic blade 34 is:

$10^6$V/cm<Emax<$10^8$V/cm

The maximum voltage Vmax exerted between the electrode 4a and developing sleeve 33 under the conditions of this embodiment example fell within this appropriate range.

In this embodiment example, the oscillating voltage applied to the elastic blade 34 is constant-voltage controlled. Therefore, when the maximum voltage exerted between the electrode 34a and developing sleeve 33 is large, the charge given to the surface layer of the toner layer of the developing sleeve 33 is increased, and when the maximum voltage exerted between the electrode 34a and developing sleeve 33 is small, the charge given to the surface layer of the toner layer on the developing sleeve 33 is suppressed.

Subsequently, the charge given from the elastic blade 34 to the toner in the surface layer the toner layer on the developing sleeve 33 is suppressed under the low humidity environment, and is increased in the high humidity environment. Thus, it does not occur that the toner is overcharged under the low humidity environment, or that the toner is insufficiently charged under the high humidity environment. In other words, the toner can be charged to a proper level.

As described above, this embodiment example could charge the toner to a proper level regardless of the environmental changes. As a result, even after the apparatus was continuously used for a long time, the preferable image, that is, an image without density deterioration, could be obtained.

As for the material for the above elastic blade base 34b, it is not limited to the hydrin rubber, but instead, any material will do as long as it displays a proper degree of change in the resistance value in response to the environmental changes. For example, material such as urethane, NBR, EPDM or the like may be employed after adjusting its resistance value by dispersing carbon or the like within it.

The polarity of the DC component of the bias applied to the electrode 4a may be either positive or negative. Also the waveform of the AC component Thereof is optional; it may be any of sine wave, rectangular wave, triangular wave, or the like; it may be in the form of a pulse wave. In essence, any waveform will do as long as the waveform contains an oscillating component.

The positioning of the electrode 34a is not limited to locations within the elastic blade base 34b. Any location will suffice as long as it is such that elastic blade base 34b is interposed between the developing sleeve 33 and electrode 34a. For example, the electrode 34b may be disposed on the back surface of the elastic blade 34.

EMBODIMENT 7

Figure 14:
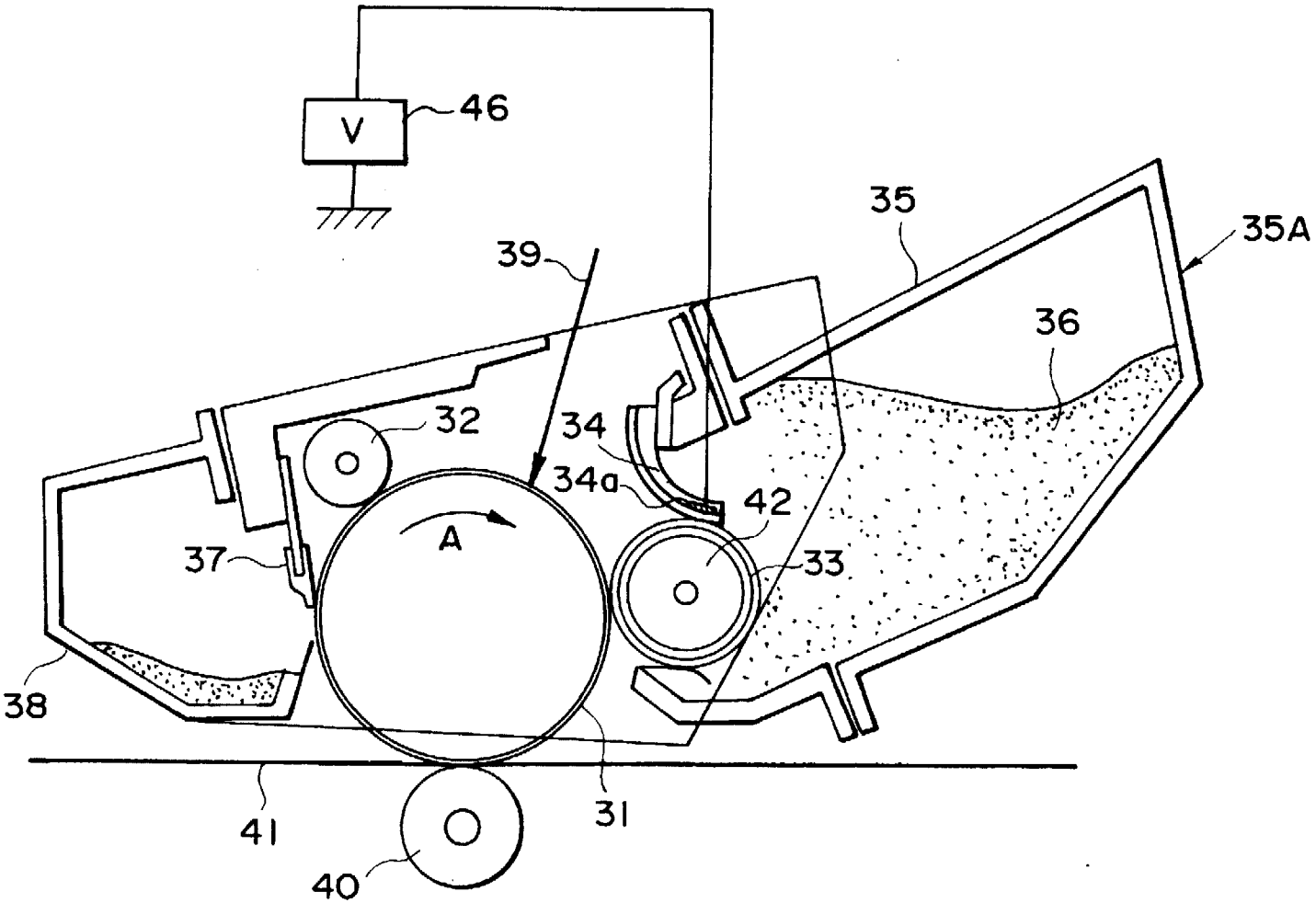
FIG. 14 is a schematic sectional view of a process cartridge comprising another example of the embodiment of developing apparatus according to the present invention.

FIG. 14 is a schematic sectional view of another example of the embodiment of developing apparatus according to the present invention. In this embodiment, a developing apparatus 5A is disposed within a process cartridge, which further comprises a photosensitive drum 31, a primary charger roller 32, a cleaning blade 37, or the like, and can be exchangeably installed in the main assembly of an image forming apparatus. In FIG. 14, a reference numeral 38 designates s waste toner box for accumulating the toner recovered as the photosensitive drum 31 surface is cleaned with the cleaning blade 37, and this waste toner box 38 is also integrated into the process cartridge.

The developing apparatus 35A structure itself is the same as the one in the fifth embodiment example, and its components designated by the same alphanumeric references as those used in FIG. 9 are the same components as those in the fifth embodiment example.

Also in this embodiment example, the elastic blade base 34b may be formed of material which changes its resistance value in response to the humidity, and then, a blade bias comprising an oscillating component may be applied under the constant-voltage control.

Thus, it becomes possible to provide a small and simple process cartridge which is not affected by long continuous usage or the environment in which it was used.

In the above process cartridge, the developing apparatus 35A is integrated into a single unit together with the primary charge roller 32, cleaning blade 37, or the like, but the cartridge design is not limited to this arrangement. It may be any design as long as it comprises at least the developing apparatus and allows the cartridge to be exchangeably installed in the main assembly of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer carrying member for carrying developer, opposed to an image bearing member for bearing an electrostatic image;

a regulating member for regulating an amount of the developer to be applied on said developer carrying member;

wherein the amount of the developer to be applied on said developer carrying member is regulated to no less than 0.6 mg/cm$^2$ and no more than 1.5 mg/cm$^2$ by said regulating member; and electric field generating means for generating an oscillating electric field between said developer carrying member and said regulating member, wherein a maximum electric field intensity of the oscillating electric field is not less than $10^6$ V/M and not more than $10^8$ V/M.

2. A developing apparatus according to claim 1, wherein the developer is a single component toner.

3. A developing apparatus according to claim 1, wherein the developer is a single component magnetic toner.

4. A developing apparatus according to claim 1, wherein said regulating member is elastically pressed upon said developer carrying member.

5. A developing apparatus according to claim 4, wherein said regulating member comprises a rubber layer contactable with the developer to triboelectrically charge the developer.

6. A developing apparatus according to claim 1, wherein said electric field generating means generates an electric field in which a force to move the developer from said developer carrying member to said regulating member.

7. A developing apparatus according to claim 1, wherein said regulating member comprises either an electrically conductive grounded layer, or an electrically conductive layer to which a bias voltage is applied.

8. A developing apparatus according to claim 1, wherein the average surface roughness Ra of said developer carrying member is no less than 0.5 μm and no more than 1.5 μm.

9. A developing apparatus comprising:

developer carrying member for carrying developer, opposed to an image bearing member bearing an electrostatic image, said developer carrying member having an electroconductive base member;

a regulating member for regulating a thickness of the developer layer to be carried on said developer carrying member, said regulating member comprising an electrode extending along a length of said developer carrying member, said electrode having a width, in the moving direction of said developer carrying member, of no less than 0.3 mm and no more than 2.00 mm; and an electric field generating means which generates an oscillating electric field between said electroconductive base member and the electrode.

10. A developing apparatus according to claim 9, wherein the developer is a single component toner.

11. A developing apparatus according to claim 10, wherein the developer is a single component magnetic toner.

12. A developing apparatus according to claim 9, wherein said regulating member is elastically pressed upon said developer carrying member.

13. A developing apparatus according to claim 9, wherein said regulating member comprises a rubber layer contactable with the developer to triboelectrically charge the developer.

14. A developing apparatus according to claim 13, wherein said electrode is formed of electrically conductive rubber.

15. A developing apparatus according to claim 9, wherein the maximum intensity of the electric field generated between said regulating member and developer carrying member is no less than $10^6$ V/m and no more than $10^8$ V/m.

16. A developing apparatus according to claim 9, wherein said electric field generating means generates an electric field in which a force to move the developer from said developer carrying member to said regulating member.

17. A developing apparatus according to claim 9, wherein said electric field generating means grounds said electrode.

18. A developing apparatus according to claim 9, wherein said electric field generating means applies a bias voltage to said electrode.

* * * * *

UNITED STATES PATENT AND TRADEMARK OFFICE

CERTIFICATE OF CORRECTION

PATENT NO. : 5,682,585

DATED : October 28, 1997

INVENTOR(S) : Seiji YAMAGUCHI et al.

It is certified that error appears in the above-identified patent and that said Letters Patent is hereby corrected as shown below:

Column 1:

Line 66, "The" should read --the--.

Column 2:

Line 35, "comprises:" should read --comprising: a--.

Column 4:

Line 25, "the" should be deleted; and
Line 55, "is" should read --are--.

Column 5:

Line 18, "approximate" should read --approximately--;
Line 40, "wave-form" should read --waveform--; and
Line 45, "Under" should read --under--.

Column 6:

Line 63, "width" should read --width of--.

Column 7:

Line 39, "are" should read --two are--.

UNITED STATES PATENT AND TRADEMARK OFFICE

CERTIFICATE OF CORRECTION

PATENT NO. : 5,682,585
DATED : October 28, 1997
INVENTOR(S) : Seiji YAMAGUCHI et al.

It is certified that error appears in the above-identified patent and that said Letters Patent is hereby corrected as shown below:

Column 10:

Line 31, "end" should read --and--.

Column 11:

Line 1, "To" should read --to--;
Line 29, "moves" should read --move--;
Line 30, "force" should read --forth--; and
Line 57, "electrodes 4a" should read --electrode 4a--.

Column 12:

Line 5, "thereby" should read --thereby reducing--.

Column 13:

Line 37, "Thereof" should read --thereof--; and
Line 58, "s" should read --a--.

UNITED STATES PATENT AND TRADEMARK OFFICE

CERTIFICATE OF CORRECTION

PATENT NO. : 5,682,585 Page 3 of 3,

DATED : October 28, 1997

INVENTOR(S) : Seiji YAMAGUCHI et al.

It is certified that error appears in the above-identified patent and that said Letters Patent is hereby corrected as shown below:

Column 14:

Line 51, "to move" should read --moves--.

Column 16:

Line 7, "$10^6$V/m" should read --$10^6$ V/M--;
"$10^8$V/m" should read --$10^8$ V/M.--
Line 10, "to move" should read --moves--.

Signed and Sealed this

Twenty-third Day of June, 1998

*Attest:*

*Attesting Officer*

BRUCE LEHMAN

*Commissioner of Patents and Trademarks*